US006012961A

United States Patent [19]

Sharpe, III et al.

[11] Patent Number: 6,012,961

[45] **Date of Patent: *Jan. 11, 2000**

[54] ELECTRONIC TOY INCLUDING A REPROGRAMMABLE DATA STORAGE DEVICE

[75] Inventors: Henry D. Sharpe, III, Saunderstown; Ralph Beckman; Stephen A. Schwartz, both of Providence, all of R.I.

[73] Assignee: Design Lab, LLC, R.I.

[ * ] Notice: This patent issued on a continued prosecution application filed under 37 CFR 1.53(d), and is subject to the twenty year patent term provisions of 35 U.S.C. 154(a)(2).

[21] Appl. No.: 08/856,199

[22] Filed: May 14, 1997

[51] Int. Cl.[7] ..... A63H 30/00; A63H 3/28

[52] U.S. Cl. ..... 446/298; 446/175

[58] Field of Search ..... 446/175, 297, 446/298, 299, 300, 301, 302, 303

[56] References Cited

U.S. PATENT DOCUMENTS

| | | | |
|---|---|---|---|
| 4,654,659 | 3/1987 | Kubo . | |
| 4,660,033 | 4/1987 | Brandt . | |
| 5,074,821 | 12/1991 | McKeefery et al. . | |
| 5,108,341 | 4/1992 | DeSmet . | |
| 5,376,038 | 12/1994 | Arad et al. . | |
| 5,488,571 | 1/1996 | Jacobs et al. . | |
| 5,594,462 | 1/1997 | Fishman et al. . | |
| 5,607,336 | 3/1997 | Lebensfeld et al. . | |
| 5,655,945 | 8/1997 | Jani | 446/175 |
| 5,724,074 | 3/1998 | Chainani et al. . | |
| 5,752,880 | 5/1998 | Gabai et al. | 434/308 |
| 5,873,765 | 2/1999 | Rifkin et al. | 446/175 |

OTHER PUBLICATIONS

"Inside 'Big Trak'", Reprinted from Robotics Age, vol. 2 No. 1, Spring 1980, pp. 172–173.

"A Computer–Controlled Tank", Reprinted from BYTE, Feb. 1981, pp. 80–94.

"Motion Control", Microprocessor Based Robotics, Intelligent Machine Series, Marks, Robillard (1983).

*Primary Examiner*—Valencia Martin-Wallace
*Assistant Examiner*—John Paradiso
*Attorney, Agent, or Firm*—Barlow, Josephs & Holmes

[57] ABSTRACT

An electronic toy includes a user reprogrammable data storage device, such as recordable tape media, or digital memory, whereby a user can selectively download program information into the data storage device to change the independent operating characteristics of the toy. The program information is preferably generated by a personal computer wherein program information can be accessed from various media, including magnetic disc, CD-ROM, and/or a remote computer system via modem. In one preferred embodiment, the toy consists of an animatronic teddy bear having a reprogrammable digital memory. The program information, which may include audio data for speech and control data for movement of animatronic body parts, is transferred into the toy's reprogrammable memory by removable cables connected between the computer and a control processor in the toy. Program information can also be provided by, and/or downloaded from a remote computer system. After the download of information is complete, the cables are disconnected, and the toy can operate in a stand-alone mode wherein the stored program information is played back to operate the device. Alternatively, the toy can be operated directly from output generated in real-time by the computer while connected to the computer, or by remote computer connected to the local personal computer.

10 Claims, 5 Drawing Sheets

ELECTRONIC TOY INCLUDING A REPROGRAMMABLE DATA STORAGE DEVICE

BACKGROUND AND SUMMARY OF THE INVENTION

The instant invention relates to electronic toys, and more particularly to an electronic toy having a reprogrammable or recordable data storage device, such as recordable tape media, or programmable digital memory, whereby a user can selectively download program information into the data storage device to change the operating characteristics of the toy during use.

Animatronic toys which operate based on predetermined program information have heretofore been known in the art. In this regard, the U.S. patents to Baer U.S. Pat No. 4,846,693; McKeefery et al U.S. Pat. No. 5,074,821; and DeSmet U.S. Pat. No. 5,108,341 represent the closest prior art to the subject invention of which the applicant is aware.

In general, the prior art toys which utilize tape media as a source of program information include a tape playback unit for playing the recorded tracks on the tape. Typically, sound data is provided on one track while control data is provided on a second track. A second tape-based system relies on a multi-track tape player to produce one of several outputs (playback of different audio tracks or pre-programmed control data) based on the selection of a particular tape track, typically via switch inputs. The play scenarios in these toys are changed by changing the tape cassette in the toy. The manufacturers of these toys usually offer many different tape cassettes to extend and increase the play value of the toy. With regard to the prior art toys which utilize digital memory, the program information is pre-programmed into the toy and cannot be changed by the user. While the above-noted devices are highly effective for their intended purpose, the long term play value of the currently available toys is diminished by the limited ability (tape), or complete inability (conventional ROM or EPROM based digital memory), to routinely change the play characteristics of the toy. There is thus a perceived need in the art for an improved toy which more readily enables the user to modify or replace the program characteristics of the toy on a routine basis.

In this regard, the instant invention provides an electronic toy having a reprogrammable, or recordable, data storage device, such as a recordable tape media, or digital memory, whereby a user can selectively download new program information into the reprogrammable data storage device from an external data source to change the operating characteristics of the toy. As a result, a reprogrammed toy would generate totally different outputs in response to inputs. In this regard, not only could a toy's sounds be new, but its entire behavior and associated play pattern could be replaced.

In a very basic form, the toy comprises a reprogrammable digital (flash) memory for storing program data, an output device which is operative responsive to the stored program data, and a control device associated with the memory and output device for selectively operating the output device. For example, the toy might comprise a toy fire engine having a speaker (output device) for outputting audio, and a plurality of push-button switches (inputs) which, when pressed, cause an associated CPU (control device) to access various program data stored in memory, and generate sounds therefrom. The instant concept of downloading program data enables the user to replace the existing sound data with new sound data thereby changing the sound generated when pushing a selected switch. Changing the sounds renews the play value of the toy and extends the life of the toy beyond the original characteristics. Alternatively, the toy fire engine may include a drive motor for driving the wheels of the vehicle, and the memory may be programmed with control data for controlling operation of the drive motor, and associated steering mechanisms. In this regard, the existing control data, which may control a set operating sequence, could be replaced with new control data to change the operating sequence. Even further still, the present concept of downloading program information into a storage device in a toy can be extended to include download of both audio and control data.

New program information can be downloaded into the toy from a variety of available data sources, such as audio tape, video tape and other magnetic media. However, the preferred source for generating new program data comprises a personal computer wherein a virtually unlimited amount of program information can be accessed from various storage media, including magnetic disc, CD-ROM, and/or a remote computer system via modem. Program information from the data source, i.e. personal computer, can be transferred to the toy's data storage device by input lines releasably connected between an output port of the data source and an input port in the reprogrammable data storage device. In contrast, the prior art as described hereinabove is animated and interactive while tethered or in close proximity to the data source (e.g. audio or videotape). The present toy is unique in that its stand-alone behavior is uniquely modified each time the toy is removed from the data source. Moreover, the user can select and choose the modifications or alterations.

In one preferred embodiment of the invention, as described in detail herein, the instant invention provides an animatronic toy in the form of a teddy bear, or other type of child-friendly character, including a body, a speaker for outputting audio responsive to audio data, and an animated body part, preferably an animated mouth, which moves in synchronization with the audio so that the bear appears to be speaking.

The audio data and control data are preferably generated by a personal computer system including a CD-ROM drive and appropriate software wherein the toy is operable to narrate stories, interact with characters on the computer video output, and/or serve as an interactive learning companion for the user. The control data and audio data is fed to the toy via a tethered cable running from the audio output port of the computer system. Most home computers are now equipped with an audio card which includes a speaker port for connection to external speakers. The control data and audio data is directed out of the speaker port as ordinary sound output and fed to the toy through a switching network. The switching network selectively routes the output signals to the external computer speaker, and to the servo motor and internal toy speaker depending on the various output scenarios.

In accordance with the instant invention, the toy bear includes a recordable data storage device such as recordable tape media, or digital memory, whereby control data and audio data from the personal computer, or from a remote computer, is downloaded into the data storage device in the toy bear for use in a stand-alone, i.e. un-tethered, mode. When download of the data is complete, the cable is removed from the toy and the recorded control data and audio data is played directly to the speaker and servo motor so that the bear functions without any external connection to the computer. In this manner, stories, games, or songs can be downloaded into the toy and played back when desired, i.e. when the child is on a trip in the car, or in bed at night to tell a bed-time story. While the prior art discloses the provision of playback devices for playing pre-recorded tape media, none of the prior art devices disclose an integral reprogrammable data storage device located within the toy which can be connected to a computer or other storage device to receive data for use in an un-tethered mode.

The control software on the personal computer is further capable of accessing remote computer systems to gather additional input data and/or input files for use with the CD-ROM, or to provide a remote source of real-time control data and audio data to feed directly to the toy while tethered. In one contemplated use, new files and program information can be downloaded from a remote source maintained and periodically updated by the manufacturer. The software can then utilize these new files by themselves, or in conjunction with other existing files on the CD-ROM to create new story scenarios, songs, games etc. In another scenario, the software can access the remote computer to provide a stream of control data and audio data on a real-time basis. Accordingly, the toy is controlled by data received directly from the remote computer.

The animatronic toy still further can include an input device for inputting data to the software running (in the tethered case) on both the PC and on the toy's CPU, and (in the un-tethered case) on the toy's CPU alone, for varying the control data and audio data that is sent to the toy's output devices. The input would change the generated output to correspond to the state specified by the software for a given input state. For example, the animatronic toy might include pressure switches, optical inputs, or microphone for inputting voice data to the software. In this regard, the software would be responsive to the input from the animatronic toy.

Accordingly, among the objects of the invention are:

the provision of a reprogrammable electronic toy including a reprogrammable data storage device whereby a user can selectively download program information into the data storage device to change the operating characteristics, i.e. behavior and play pattern, of the toy;

the provision of an electronic toy which is controlled by program data generated by control software on a personal computer; and the provision of a toy that works in two separate modes, namely a tethered mode wherein the toy is connected to a personal computer, and a stand alone mode wherein the behavior of the toy can be modified each time it is connected to the personal computer;

the provision of an electronic toy, wherein the control software can access program data from various sources, including magnetic media, CD-ROM media, and remote computer systems via modem.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
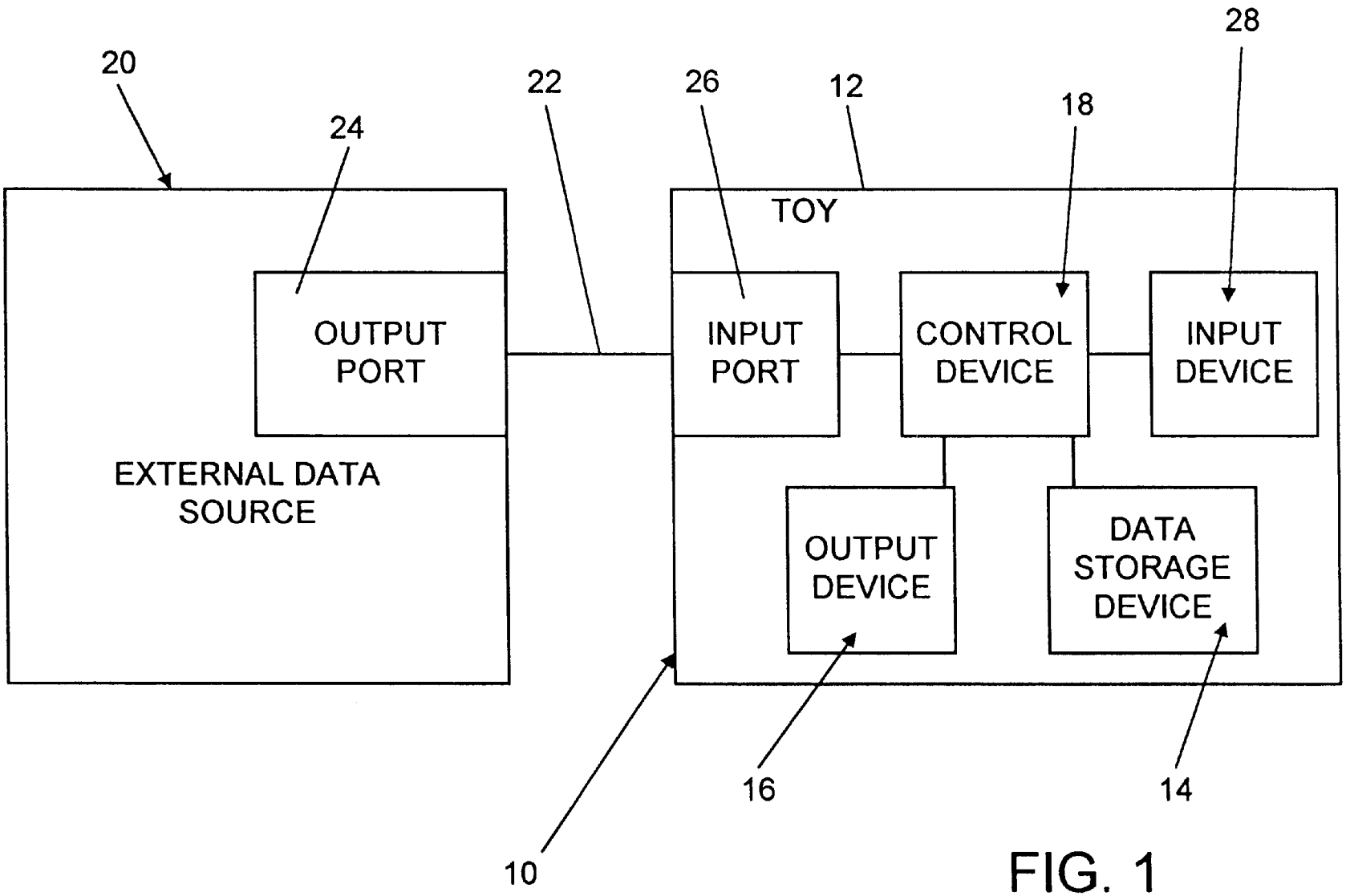
FIG. 1 is a schematic block diagram of a basic electronic toy arranged in accordance with the teachings of the instant invention.

Referring now to the drawing figures, a basic embodiment of a reprogrammable electronic toy in accordance with the invention is illustrated and generally indicated at 10 in FIG. 1. The toy 10 comprises a base unit 12, an integral, user reprogrammable, or user recordable, data storage device 14, such as recordable media, including but not limited to magnetic tape, hard drives, writable CD-ROM or reprogrammable solid state memory including flash memory, EEPROM, or battery backed RAM, for storing program data directly within the toy, an output device generally indicated at 16 operable responsive to the program data, and a control device generally indicated at 18 associated with the data storage device 14, and the output device 16 for selectively controlling the input and output of program data to and from the data storage device 14, and the output of control data to the output device 16. The arrangement of the control device 18 and data storage device 14 is such that a user can selectively download program information into the reprogrammable data storage device 14 from an external data source generally indicated at 20 to change the stand-alone operating characteristics, i.e. behavior and play pattern, of the toy 10. Program information from the data source 20, i.e. personal computer, can be transferred to the toy's data storage device 14 in many ways not intended to be limited by the present description herein. However, the present embodiment details a download method comprised of input/output lines 22 releasably connected between an output port 24 of the data source 20 and an input port 26 in the toy 10.

The toy 10 further includes an input device 28 to feed input data to the control device 18 wherein the control device 18 could selectively operate the output device 16 responsive to both the program data and the input data from the input device 28.

Figure 2:
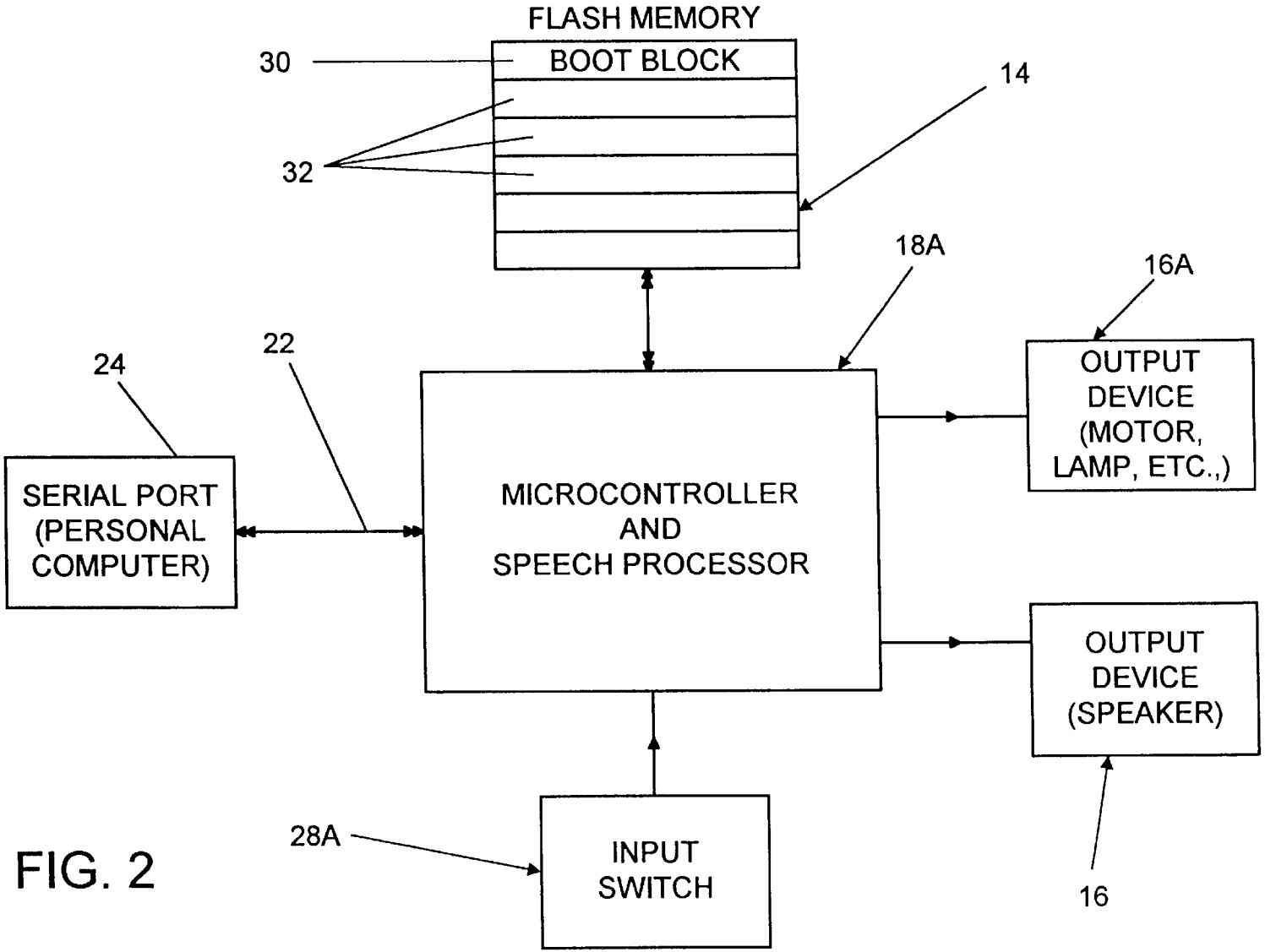
FIG. 2 is a detailed schematic block diagram of a microprocessor based toy in accordance with the invention.

Referring to FIG. 2, for example, the toy 10 might comprise a toy fire engine (base unit 12) having a speaker (output device 16) for outputting audio, and a plurality of push-button switches 28A (input devices 28) which, when pressed, cause an associated microcontroller (control device 18A) to access various program data stored in a digital flash memory (storage device 14), and generate sounds therefrom. Additional output devices 16 A could also include lamps or motors that are activated either singly or in various combinations in response to the specific input scenarios as specified by the program data stored in the storage device 14. While it is specifically stated that a microcontroller device is utilized in the present embodiment, it is to be understood that various other types of control devices would be equally as effective for the intended purpose. For example, a device known as a state machine could be utilized in the place of the microcontroller.

The external data source 20 preferably comprises a personal computer wherein program information is downloaded through removable cables 22 connected between a serial port (output port 24) on the computer 20 and the microcontroller 18A.

Still referring to FIG. 2, the digital flash memory 14 includes a permanent boot block 30 containing software for communicating with an external personal computer 20 and further containing commands that allow the PC 20 to execute specific code. The remaining memory sectors 32 are reprogrammable to contain new application programs and speech data.

In general, the toy 10 is operable in three modes, namely, a download mode, an interactive tethered mode, and an un-tethered stand-alone mode. In the download mode, new program information from a PC 20 is downloaded into the flash memory 14. The permanent code in the flash memory boot block 28 allows the microcontroller 18A to communicate with the PC 20 and load new data sequentially into the reprogrammable portions 32 of the memory 14. In the interactive mode, while tethered to the PC 20, the PC 20 can send commands through the serial port 24 whereby the microcontroller 18A executes the commands. In this regard, the download mode is a special case of the interactive tethered mode wherein the command is to reprogram the existing data in the flash memory 14. Other commands could include speaking certain words or generating a particular animatronic servo control signal, turning on a lamp, etc. If the serial port 24 is two-way (previous download mode only requires a one-way serial port from PC 20 to microcontroller 18) then the microcontroller 18 can send messages back to the PC 20, that for example, a certain input was activated, e.g. a certain input switch 30 was closed. In the un-tethered, i.e. stand-alone mode, the microcontroller 18 executes the downloaded program in stand-alone mode. More specifically, it monitors input and generates outputs according to the downloaded software, and in this regard, the downloaded program data can include new control data as well as new speech data.

The instant concept of downloading the program data enables the user to selectively replace the existing program data, such as sound or speech data, with new program data thereby changing the behavior of the toy 10 when pushing a selected switch input 28A. Changing the behavior of the toy 10 renews the play value of the toy 10 and extends the life of the toy 10 beyond the original characteristics. In another possible embodiment, the toy fire engine might include a drive motor (output device 16A) for driving the wheels of the vehicle, and the memory 14 may be programmed with control data for controlling operation of the drive motor 16A, and associated steering mechanisms. In this regard, the existing program data, which may control a set operating sequence, could be replaced with new program data to change the operating sequence.

New program information can be downloaded into the toy 10 from a variety of available external data sources 20, such as audio tape, video tape and other magnetic media. However, the preferred external data source 20 for generating new program data comprises a personal computer wherein a virtually unlimited amount of program information can be accessed from various storage media, including magnetic disc, CD-ROM, and/or another remote computer system via modem. More specifically, the PC is preferred because, in addition to reprogramming the toy's internal data storage device 14, it can also function in an interactive fashion with the toy 10 while they are tethered together. In a digital storage configuration, selectively switching the data storage device 14 between a programming mode and an output mode can be achieved by a two-position control switch (not shown) on the controller device.

In general, the control devices 18 and digital storage devices 14, such as microcontrollers, microprocessors, and flash memory, the use of which is described herein, are well known in the electronic arts, and therefore the specific wiring and control parameters necessary for operation thereof will not be described in detail with respect to the basic embodiment.

Figure 3:
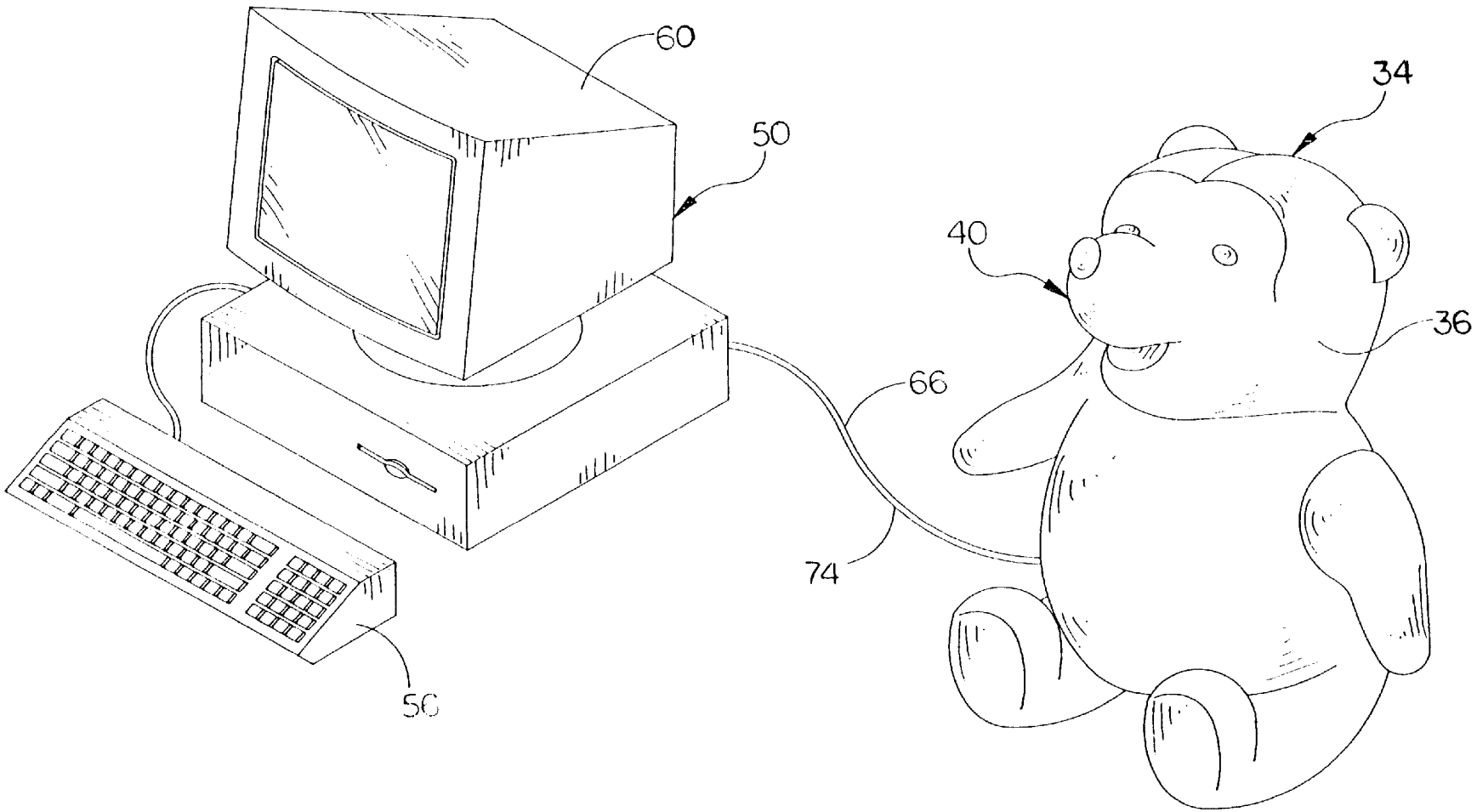
FIG. 3 is a perspective view of an analog based animatronic toy arranged in accordance with the teachings of the instant invention.
Figure 4:
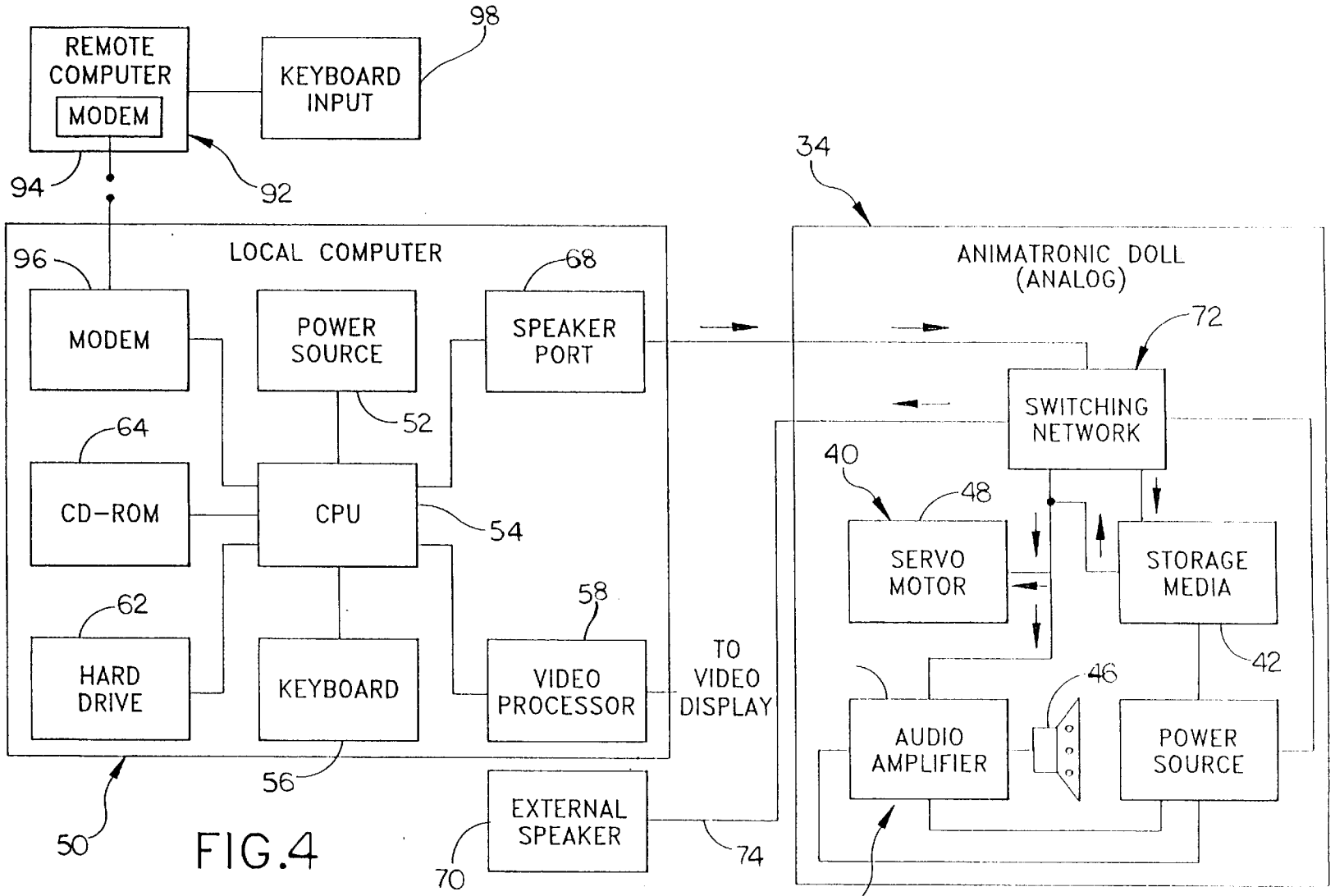
FIG. 4 is a schematic block diagram of the animatronic doll and the associated computer system.
Figure 5:
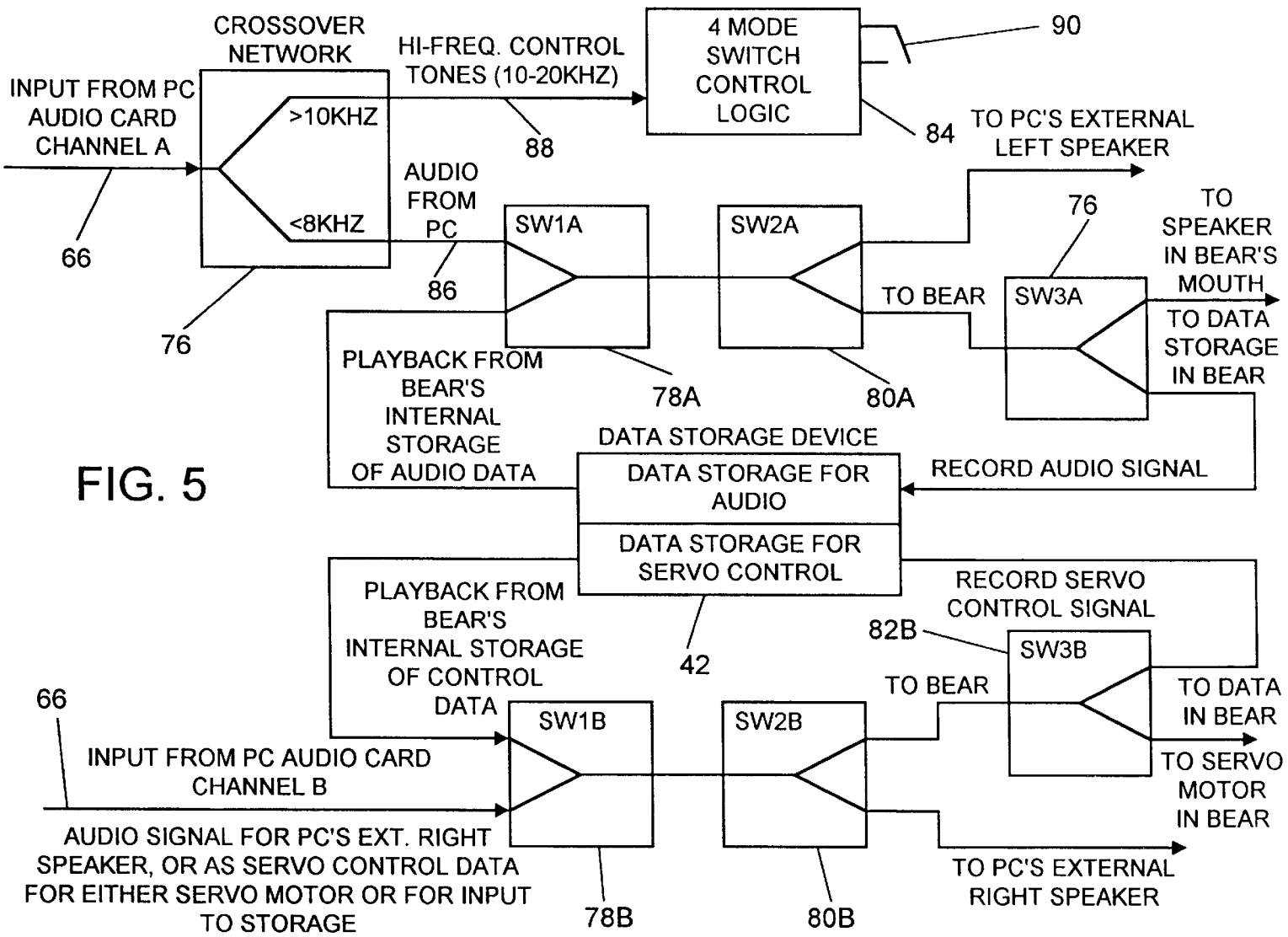
FIG. 5 is a detailed schematic block diagram of the switching network and data storage components of the animatronic toy.

Referring now to FIGS. 3–5, a reprogrammable animatronic toy in accordance with the teachings of the instant invention is illustrated and generally indicated at 34. As will hereinafter be more fully described, the instant animatronic toy 34 is operative to simulate the speech and movement of a live being, and is preferably functional as an animatronic companion for a personal computer system for both entertainment and educational purposes.

In general, the animatronic toy 34 comprises a body 36, preferably fashioned in the form of a teddy bear, or alternatively as another type of child-friendly character. The toy 10 further comprises an audio output assembly generally indicated at 38 for outputting audio responsive to audio data, an animated body part assembly generally indicated at 40, preferably an animated mouth, which moves in synchronization with the audio so that the toy 34 appears to be speaking, and a reprogrammable data storage device 42, such as recordable media as described hereinabove, whereby program data can be downloaded into the data storage device for use of the toy in a stand-alone, i.e. un-tethered, mode.

The audio output device 38 comprises an audio amplifier 44, and a speaker 46, each of which is well known in the electronic arts. The animated body part (mouth) 40 comprises a servo motor 48, and other integrated mechanical linkage (not shown) which is operative for moving the mouth 40 between open and closed positions, and positions therebetween. The particular type of servo motor 48 and linkage can vary according to the animated body part, however, the general concept of movement remains the same. A representative type servo linkage and explanation of servo control is illustrated and described in the U.S. Patent to DeSmet U.S. Pat. No. 5,108,341 which is incorporated herein by reference.

The synchronization of the animated mouth 40 and the audio output is preferably achieved by a two channel audio output signal wherein the audio data is provided on one output channel and control data is provided on another output channel to the servo motor 48 which drives the mouth linkage. This type of synchronization arrangement is also explained in the '341 U.S. Pat. No. to DeSmet, and will not be described in detail within this specification.

The audio data and control data are preferably generated by a personal computer system generally indicated at 50, typically including a power source 52, central processing unit 54, keyboard input 56, video processor 58, video display 60, hard drive 62, CD-ROM drive 64 and appropriate software, wherein the toy 34 is operable to narrate stories, interact with characters displayed on the computer video display 60, and/or serve as an interactive learning companion for the user. In operation, the software operating on the personal computer 50 selectively accesses various program data from a CD-ROM disc (not shown) received in the CD-ROM drive 64 including, but not limited to, audio files, video files, and control files, and generates output including video data to output to the video display 60, and a two channel audio output signal, including the control data and audio data, to output to the toy 34. "Multi-media" CD-ROM software applications are well known in the entertainment arts, and the specific provisions of the software and program data required to achieve and create the present functional characteristics of the toy 34 are believed to be well within the knowledge and expertise of those skilled in the art. Accordingly, the specific details of the software and program data will not be described herein. While it is specifically indicated that the program data is located on a CD-ROM disc, it is to be clearly understood that the program data and/or software application is located on the CD-ROM disc for convenience only, and that the program data, software etc. may be located on any type of readable data storage means operable with the personal computer 50.

As another alternative for generating the control data and audio data, the application software could be provided with the capability to generate synchronized control data and audio data from text files. Just as many applications exist for generating the spoken word from ASCII text (generally called "text to speech" applications), it is feasible to generate a second synchronized audio output that instead of being spoken words, would be an analog control signal that would move an animated body part (the mouth) synchronously with the first voice track. In this manner, the user could write their own stories into a text file, and have the software generate the control data and audio data so that the toy 34 could be operative to tell the story that the operator created. Likewise, the text of existing stories could be scanned into a text file for conversion into synchronized audio and control data.

The control data and audio data, i.e. composite audio output signal, generated by the application software is fed to the toy 34 via a tethered cable 66, i.e. speaker wire, running from an audio output port 68 of the computer system 50. It is pointed out that most personal computers are now equipped with a stereo audio card which includes a speaker port for connection to external speakers 70. The composite audio output signal (left channel might be audio, right channel might to audio) is directed out of the speaker port 68 as ordinary sound output. Although a physical tether connection is specifically illustrated, it is contemplated that the audio output could be communicated to the toy 34 via other means, such as a wireless radio communication system as utilized for wireless speaker systems.

The audio output signal traveling through the tether line 66 is first fed to a switching network generally indicated at 72 located within the body 12 of the toy 10. The switching network 72 selectively routes the audio output signal either back to the external computer speakers 70 through a separate speaker wire 74, or to the recordable storage media 42 within the toy 34, or directly to the servo motor 48 and audio output 38 depending on various output scenarios. More specifically referring to FIG. 5, the switching network 72 comprises a crossover circuit generally indicated at 76, three double pole double throw (DPDT) switches indicated at 78A,78B, 80A,80B, and 82A,82B, and a switch logic control 84 for controlling the positions of the switches 78, 80, 82. The audio output signal from one channel (Channel A) of the speaker wire 66 is directed into an input of the crossover circuit 76 while the output from the other channel (Channel B) is directed into one of the switches 78B (SW1B). In general, the cross-over circuit 76 is operable for dividing or filtering certain frequency ranges of the audio output signal for passage to two output paths 86, 88 respectively, and in this regard, the particular crossover circuit 76 utilized herein is constructed to discriminate between frequency ranges below 8,000 Hz and above 10,000 Hz. Audio output below 8,000 Hz (this is the actual audio component which is output to the speaker), is passed to the first output line 86 which feeds through switches 78A (SW1A), 80 A(SW2A), and 82 A(SW3A). Audio output above 10,000 (these high-frequency tones comprise control tones) are passed to the second output 88 which is fed into the switch logic control 84 to control the positions of all three DPDT switches 78, 80, 82. Frequencies of 10,000 Hz, 12,000 Hz, 14,000 Hz and 16,000 Hz each control operation of the toy 34 in four different modes as outlined in the table below. Routing of the signals from the switching network 76 to the various output paths is generally self-explanatory from the table below and accompanying drawing FIG. 5.

| Description of Mode | Tone | Mode | SW1A | SW1B | SW2A | SW2B | SW3A | SW3B |
|---|---|---|---|---|---|---|---|---|
| PC Audio Card plays sound through both external speakers | l0 khz Audio) | 1 left | From PC Audio Right | From PC (signal is | To External speaker | To External speaker | N/A | N/A |
| PC Makes Bear Talk | l2 khz | 2 | From PC Audio | From PC (Signal is servo control) | To Bear in Bear's mouth | To Bear | To Speaker | To Servo motor in Bear |
| PC Downloads to Bear's storage device | l4 khz | 3 | From PC Audio | From PC (Signal is servo control) | To Bear | To Bear | To Bear's storage for Audio data | To Bear's storage for servo control |
| Bear plays back from storage | l6 khz | 4 | From Playback of Bear's Audio Storage | From Playback of Bear's servo control Storage | To Bear | To Bear | To Speaker in Bear's mouth | To Servo motor in Bear |

Mode 1 is a tethered mode wherein the PC audio card simply routes audio signals through the bear 34 back to the PC external speakers 70. This mode is used simply to play music or to make characters on the video display 60 of the computer 50 speak. Mode 2 is also a tethered mode wherein the audio and control signals are routed directly to the servo motor 48 and speaker 46 in the bear 34 to make the bear 34 speak when in attached to the PC 50. Mode 3 is another tethered mode used to download audio and control data to the data storage device 42. Finally, mode 4 is yet another tethered mode wherein the bear 34 plays back data stored in the data storage 42 while tethered. The signals are routed out through the switches 78, 80, 82 to the bears servo motor 48 and speaker 46. Most importantly, to operate the bear 34 in an un-tethered mode, the switch control 84 is provided with a switch 90 which can be closed to place the bear 34 in a playback mode, i.e. mode 4 as described above.

When the toy 34 is operable in an un-tethered mode, the two speaker wires 66, 74 are removed from the toy 34, and the recorded audio signal (control data and audio data) is played back directly to the audio amplifier 38 and servo motor 48 so that the toy 34 functions without any external connection to the computer 50. In this manner, stories, games, etc, can be downloaded into the toy 34 and played back when desired, i.e. when the child is on a trip in the car, or in bed at night to tell a bed-time story.

To further vary and enhance the ability to generate control data and audio data, the application software is further capable of accessing a remote computer system generally indicated at 92 (FIG. 4) to gather additional input data and/or input files for use with the CD-ROM, or to provide a remote source of real-time control data and audio data to feed directly to the toy 34. The remote computer system 92, as well as the local computer 50 would each therefore include a communication device 94, 96 respectively, such as a modem for communicating.

In one contemplated use, new files and program information can be downloaded from a remote computer system 92 maintained and periodically updated by the manufacturer. The application software can then utilize these new files by themselves, or in conjunction with other existing files on the CD-ROM, or other data storage sources to create new story scenarios, games etc. For example, the user could selectively dial into the remote computer system 92 and download certain files onto the personal computer hard drive 62, or alternatively, the software could be adapted for the personal computer 50 to automatically dial into the remote computer system 92 at certain times and/or dates to automatically provide the new files without taking up user time.

In another scenario, the software can access the remote computer 92 to provide a stream of control data and audio data on a real-time basis. For example, the remote computer system 92 could provide an on-line chat-line wherein users could log in, talk to other users, and/or participate in an on-line adventure scenario. Software applications running on the remote computer system 92 could send appropriate control data and audio data as well as video data for the display screen 60, back to the local personal computer 50 for controlling operation of the toy 34. Accordingly, the toy 34 is controlled by data received directly from the remote computer 92. Alternatively, the software can be configured to communicate with another personal computer wherein audio data and control data is generated by and received from the personal computer on a real-time basis to control operation of the toy. For example, the remote computer could be provided with software that automatically generates audio and control data based on text input typed into the remote computer, i.e. the remote operator could type in phrases and/or stories on a keyboard 98 wherein the software would generate the control and audio data and the toy 34 on the other end would receive the control and audio data and tell the story or speak the phrases on a real-time basis.

The animatronic toy 34, the personal computer 50, and the remote computer 92 still further can include input devices for inputting data into the application software for varying the generated control data and audio data. For example, in an interactive learning story, the software might be responsive to input from a keyboard 56 to answer questions posed by characters on the video screen or by the animatronic toy 34, etc. The input would change the generated output to correspond to the input. Likewise, the animatronic toy 34 might include input devices (not shown) such as pressure switches, optical inputs, or microphone for inputting voice data to the software. In this regard, the software would also be responsive to the input from the animatronic toy 34.

It can therefore be seen that the instant invention provides a unique, effective and versatile toy which has unlimited play value. The provision of a reprogrammable data storage device, within the toy provides the unique ability to routinely change program data and renew the play value of electronic toys. The use of a personal computer and software as an external data source provides a virtually limitless ability to generate new and unique sets of program data for download and also for real-time interactive play. Furthermore, the connection of the personal computer to a remote computer to download files or provide real-time program data further enhances the play value of the toy beyond that presently possible with tape-based data generation. Real-time adventure scenarios, games that are always new, as well as story-telling on a real-time basis, become a reality for animatronic control. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An interactive toy comprising:

a base unit having a movable part;

an electromechanical actuator mounted on board said base unit and connected to said movable part of said base unit for actuating said movable part of said base unit responsive to control data;

an audio output device mounted on board said base unit, said audio output device outputting audio responsive to audio data;

a digital processing device mounted on board the base unit, said digital processing device being in electrical communication with said electromechanical actuator for directing control data to said electromechanical actuator and directly controlling operation of said electromechanical actuator, said digital processing device being in electrical communication with said audio output device for directing sound data to said audio output device for controlling operation thereof; a reprogrammable data storage device mounted on board said base unit in electrical communication with said digital processing device for selectively storing program data for controlling operation of said digital processing device, control data to be accessed by said digital processing device during operation thereof, and sound data to be accessed by said digital processing device during operation thereof;

a data input port mounted on board said base unit in electrical communication with said digital processing device for selectively receiving said program data, said control data and said audio data from an external data source and for routing commands from an external source to said digital processing device; and a standalone power source mounted on board said base unit for providing standalone power to said electromechanical actuator, said audio output device, said digital processing device and said data storage device, said interactive toy being operative in a first tethered mode wherein said digital processing device is connected to said external data source through said data input port, said digital processing device receiving control data and sound data from said external data source, said digital processing device further receiving command data from said external data source for control of said digital processing device;

said interactive toy being operative in a second tethered mode wherein said digital processing device is connected to said external data source through said data input port, said digital processing device receiving a stream of program data, control data and audio data which are stored in said reprogrammable data storage device, and said interactive toy being operative in a third untethered mode wherein said digital processing device is not connected to said external data source, said digital processing device executing an on-board program and accessing said control data and said audio data from said reprogrammable data storage device to automatically control operation of said electromechanical actuator and said audio output device.

2. The interactive toy of claim 1 further comprising a manual input device for manually inputting input data to said digital processing device, said digital processing device being operative responsive to said input data.

3. The interactive toy of claim 1 wherein said audio data includes speech data and said digital processing device includes a speech processor device, said interactive toy being operative for outputting selected speech tracks.

4. The interactive toy of claim 1 wherein said base unit is fashioned in the shape of an animated character, said movable base unit part comprising a movable jaw member, said electromechanical actuator comprising an electronic servomotor connected to a movable jaw member, said audio data and said control data being synchronized to provide synchronized movement of the jaw and output of the speech data wherein said animated character appears to be autonomously speaking.

5. The interactive toy of claim 1 wherein said reprogrammable data storage device comprises a digital memory device having a boot block for executing an onboard boot program, and other memory blocks for storing said program data, said control data and said audio data.

6. A method of operating an electronic interactive toy of the type comprising a base unit having a movable part, an electromechanical actuator mounted on board said base unit and connected to said movable part of said base unit for actuating said movable part of said base unit responsive to control data, an audio output device mounted on board said base unit, said audio output device outputting audio responsive to audio data, a digital processing device mounted on board the base unit, said digital processing device being in electrical communication with said electromechanical actuator for directing control data to said electromechanical actuator and directly controlling operation of said electromechanical actuator, said digital processing device being in electrical communication with said audio output device for directing sound data to said audio output device for controlling operation thereof, a reprogrammable data storage device mounted on board said base unit in electrical communication with said digital processing device for selectively storing program data for controlling operation of said digital processing device, control data to be accessed by said digital processing device during operation thereof, and sound data to be accessed by said digital processing device during operation thereof, a data input port mounted on board said base unit in electrical communication with said digital processing device for selectively receiving said program data, said control data and said audio data from an external data source, and a standalone power source mounted on board said base unit for providing standalone power to said electromechanical actuator, said audio output device, said digital processing device and said data storage device, said method comprising the steps of:

connecting said on board digital processing device to said external data source through said data input port;

selectively receiving program data, control data and audio data from said external data source;

selectively storing said program data, control data and audio data into said reprogrammable data storage device for use by said digital processing device;

selectively controlling operation of said digital processing device responsive to commands from said external data source;

disconnecting said digital processing device from said external data source; and executing an on board program in a stand alone operation which accesses said program data, said control data and said audio data whereby said digital processing device is independently operative responsive to said program data for independent autonomous control of said electromechanical actuator and said audio output device.

7. The method of claim 6 further comprising the step of repeating all of said steps wherein different program data, different control data, and different audio data are stored.

8. The method of claim 6 further comprising the step of manually inputting in put data to said digital processing device through an onboard input device, wherein said program being executed by said digital processing device is responsive to said input data.

9. The method of claim 6 wherein said audio data includes speech data and said digital processing device includes a speech processor device, said digital processing device being operative for controlling output of speech.

10. The method of claim 6 wherein said base unit is fashioned in the shape of an animated character, said movable base unit part comprises a movable appendage, and said electromechanical actuator comprises an electronic servomotor connected to said movable appendage, said method further comprising the step of outputting said control data and audio data in a synchronized manner to provide synchronized movement of the appendage and output of the speech data.

* * * * *